US007530873B1

(12) United States Patent
Chang

(10) Patent No.: US 7,530,873 B1
(45) Date of Patent: May 12, 2009

(54) REFLECTIVE LIFE JACKET AND ASSOCIATED METHOD

(76) Inventor: Jolan Chang, 205 N. Lincoln Ave. #B, Monterey Park, CA (US) 91755

( * ) Notice: Subject to any disclaimer, the term of this patent is extended or adjusted under 35 U.S.C. 154(b) by 0 days.

(21) Appl. No.: 11/974,439

(22) Filed: Oct. 12, 2007

(51) Int. Cl.
*B63C 9/08* (2006.01)

(52) U.S. Cl. ..... 441/89; 441/106

(58) Field of Classification Search ..... 441/89, 441/106, 88
See application file for complete search history.

(56) References Cited

U.S. PATENT DOCUMENTS

| | | | | |
|---|---|---|---|---|
| 4,578,042 | A | 3/1986 | Evert | |
| 5,421,287 | A | 6/1995 | Yonover | |
| 5,775,966 | A | 7/1998 | Bautista | |
| 6,066,016 | A | 5/2000 | Yonover | |
| 6,511,357 | B1 * | 1/2003 | Williams et al. | 441/106 |
| 6,545,606 | B2 * | 4/2003 | Piri et al. | 340/573.1 |
| 6,910,931 | B1 * | 6/2005 | Nakase | 441/106 |
| 2005/0202907 | A1 * | 9/2005 | Otten et al. | 473/457 |

* cited by examiner

*Primary Examiner*—Lars A Olson

(57) ABSTRACT

A reflective life jacket includes a buoyant body suitably sized and shaped for fitting over an upper thoracic cavity of a user. The apparatus further includes a plurality of disposable stacked reflective strips positioned along selected regions of the body and a mechanism for removably affixing the reflective strips to the body such that an exposed one of the reflective strips contiguously lays along a top surface of the body while a reserved one of the reflective strips lays beneath the top surface and remains hidden from ambient light. The apparatus further includes a water impermeable layer abutted directly to the diaphragm and removably housed within the cavity for preventing undesirable fluids and debris from penetrating through the cavity and contacting the reserved reflective strip seated beneath the water impermeable layer.

14 Claims, 4 Drawing Sheets

REFLECTIVE LIFE JACKET AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to life jackets and, more particularly, to a reflective life jacket providing catoptric characteristics during night time.

2. Prior Art

The warmth of the summer season makes it the perfect time of year to indulge in all manners of outdoor activities. From playing a spirited game of volleyball on a sand-packed beach or lounging by the neighborhood pool to spending the day at the park or embarking on a camping adventure, people seek a myriad of ways to bask in this season's pleasantly balmy days and evenings. Perhaps no other summer pastime is more popular than riding the currents of a body of water in a floating vessel, or boat. Whether cutting through ocean waves on a luxurious yacht, navigating a placid lake on a pontoon, or steering a fishing boat down a lazy river, boaters are out on the water in record numbers come summer time, reveling in activities that are rife with sport, fun, and relaxation.

Even though recreational boaters are looking for nothing but fun when they head to the water, boating trips can sometimes turn to tragedy. According to alarming statistics provided by the United States Coast Guard, there are more than eight thousand boating accidents in the U.S. each year; of this number, 4,500 people are injured and 800 die. Approximately eighty five percent of the fatalities result from drowning, yet a significant portion of the injuries and deaths can be attributed to prolonged exposure to freezing water temperatures and the blistering, dehydrating rays of the sun. Boating accidents and mishaps can occur for various reasons, whether the vessel capsizes in choppy waters or a boater inadvertently falls from the boat and into the water.

While wearing a life jacket can prevent an accident victim from drowning, he may not be able to fully rescue himself from the water. Should an injury prevent swimming, or the boat is too heavy for the victim to right again, he is left to the mercy of the water and the elements while desperately hoping for a rescuer to come along. Unfortunately, if the accident has occurred while boating in the vast waters of the ocean, rescue personnel would have a very difficult time locating the victim, especially if night is beginning to fall. Obviously, it would be advantageous to provide a means for increasing the visibility of a person floating in a large body of water.

U.S. Pat. No. 5,775,966 to Bautista Real discloses a life-saving device with a launcher which provides for the automatic inflation of the float by simply acting on a lever. The mechanism is comprised of a gas tank or similar integral at its top portion with the float so that said tank is traversed by a hollow cut-off cock with a lower end that projects from the container or tank and is terminated by the lever. The upper end is introduced inside the float and the gas penetrates through the hollow tube of said cock. Integral with the assembly is provided a ring which is connected to the rolled-up cable which is itself integral with the launcher, the latter being provided with a gun wherein is introduced the life-saving assembly in order to launch it to a major distance. Unfortunately, this prior art example does not provide a reflective device that makes a user visible to rescuers at nighttime.

U.S. Pat. No. 6,066,016 to Yonover discloses a water craft for survival or recreational purposes, comprised of an inflatable elongate housing that provides a platform and has an internal supporting structure for rigidity and a fin or multitude of fins Ry for stability and tracking purposes as the survivor paddles the water craft by arm motion. The craft is stowed in a compact pouch when not in use and inflated by compressed gases and/or a manual hand pump to sustain the requisite partial pressures of the inflatable water craft. A thermal protective covering with brightly colored pigmentation and retro-reflective and IR-reflective surfaces is provided to protect the survivor from the elements and enhance his visibility. A non-skid surface on the platform enables the survivor to lie on top of the water craft without slipping off. A bright orange colored elongate SEE/RESCUE (trademark) streamer is provided with the water craft for continuous passive emergency signaling purposes to enable search parties to locate the survivor. An attachable leg leash is provided to keep the water craft from separating from the survivor in rough seas and/or wind conditions. A compass is built into the craft to provide direction to the survivor's mobility. In addition to survivor applications, the water craft can be used for water recreational purposes, such as surfing and paddling. Unfortunately, this prior art example does not provide a life jacket for preventing drowning.

U.S. Pat. No. 5,421,287 to Yonover discloses a signaling device for indicating, by day or night, the position of a person lost at sea (on land or in space). An elongate brilliantly colored streamer is made up of flat, flexible, inherently buoyant material with built-in support struts to keep the material at maximum outstretched surface area. The streamer can be coated with any one or more of the following in any combination: brilliant color, phosphorescent pigment, reflective material, or International Distress Signal indicia. The device may be attached to a life jacket and rolls up into a water-release container secured to the life jacket. Upon deployment, the container converts into a sun-protective, radar-visual reflective, and water catchments hat. The streamer is extended manually or automatically and can remain in an outstretched manner indefinitely. Unfortunately, this prior art example requires a separate device with manual operation.

Accordingly, the present invention is disclosed in order to overcome the above noted shortcomings. The present invention is convenient and easy to use, lightweight yet durable in design, and designed for providing catoptric characteristics during night time. The reflective light jacket is simple to use, inexpensive, and designed for many years of repeated use.

BRIEF SUMMARY OF THE INVENTION

In view of the foregoing background, it is therefore an object of the present invention to provide an apparatus for providing catoptric characteristics during night time. These and other objects, features, and advantages of the invention are provided by a reflective life jacket.

A reflective life jacket includes a buoyant body suitably sized and shaped for fitting over an upper thoracic cavity of a user. The apparatus further includes a plurality of disposable stacked reflective strips effectively positioned along selected regions of the body. Such an exposed reflective strip includes a planar top wall spanning across an entire width of the cavity, a plurality of shoulders stepped inwardly towards a center of the cavity, and an anchor finger with a triangular shape snuggly and conveniently interfitted within the slit of the diaphragm such that the exposed reflective strip is prohibited from prematurely detaching from the cavity. Such an anchor finger has a bottom surface directly abutted against a top surface of the water impermeable layer. The exposed and reserved reflective strips are coextensively shaped.

The apparatus further includes a mechanism for removably affixing the reflective strips to the body such that an exposed one of the reflective strips contiguously lays along a top surface of the body while a reserved one of the reflective strips lays beneath the top surface and remains hidden from ambient light. Such a removably affixing mechanism includes a cavity formed within the top surface of the body and advantageously spanning along the selected regions thereof. The exposed reflective strip is removably nested within the cavity. The mechanism further includes a deformably resilient diaphragm formed from elastic material spanning across an entire width of the cavity. Such a diaphragm has a longitudinal slit formed along a medial region thereof, and such a slit is resiliently adaptable between expanded and equilibrium positions when the exposed reflective strip and the diaphragm are pulled out from the cavity and the reserved reflective strip is outwardly displaced to the outer surface of the body.

The apparatus further includes a water impermeable layer abutted directly to the diaphragm and removably housed within the cavity for effectively preventing undesirable fluids and debris from penetrating through the cavity and contacting the reserved reflective strip seated beneath the water impermeable layer. Such a water impermeable layer is severed by the reserved reflective strip in such a manner that the reserved reflective strip passes upwardly through the slit as the exposed reflective strip is upwardly displaced within the cavity.

A method for utilizing a reflective life jacket providing catoptric characteristics during night time includes the steps of: providing a buoyant body suitably sized and shaped for fitting over an upper thoracic cavity of a user; providing a plurality of disposable stacked reflective strips positioned along selected regions of the body; and removably affixing the reflective strips to the body such that an exposed one of the reflective strips contiguously lays along a top surface of the body while a reserved one of the reflective strips lays beneath the top surface and remains hidden from ambient light.

The method further includes the steps of: providing a cavity formed within the top surface of the body and spanning along the selected regions thereof such that the exposed reflective strip is removably nested within the cavity; providing a deformably resilient diaphragm formed from elastic material spanning across an entire width of the cavity; and providing a water impermeable layer abutted directly to the diaphragm and removably housed within the cavity for preventing undesirable fluids and debris from penetrating through the cavity and contacting the reserved reflective strip seated beneath the water impermeable layer.

The method further includes the steps of: resiliently adapting a slit of the diaphragm between expanded and equilibrium positions when the exposed reflective strip and the diaphragm are pulled out from the cavity; outwardly displacing the reserved reflective strip to the outer surface of the body; snuggly interfitting a triangular shaped anchor finger within the slit of the diaphragm such that the exposed reflective strip is prohibited from prematurely detaching from the cavity; and severing the water impermeable layer in such a manner that the reserved reflective strip passes upwardly through the slit as the exposed reflective strip is upwardly displaced within the cavity.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
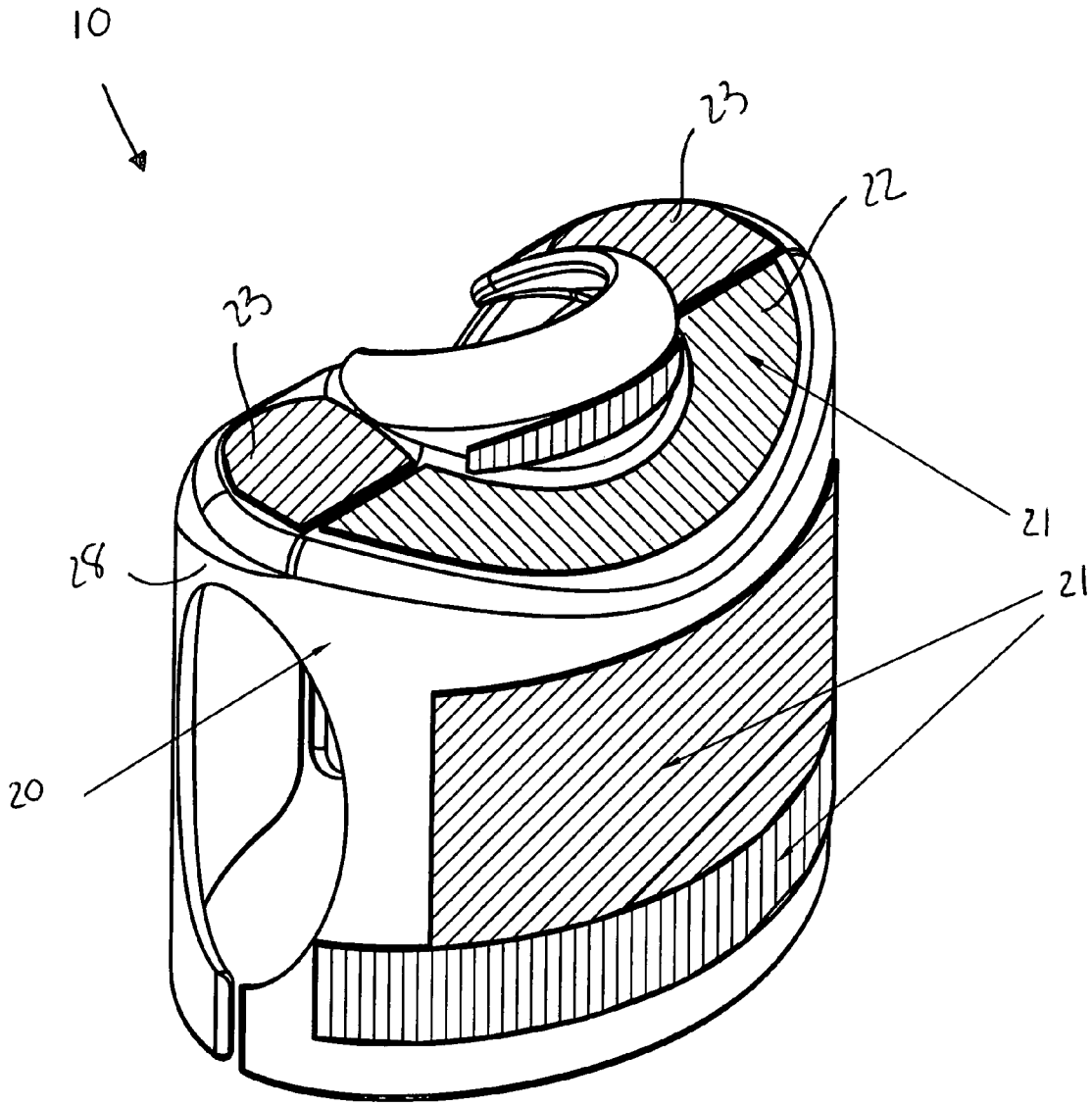
FIG. 1 is a perspective view showing the rear view of a reflective life jacket, in accordance with the present invention.
Figure 2:
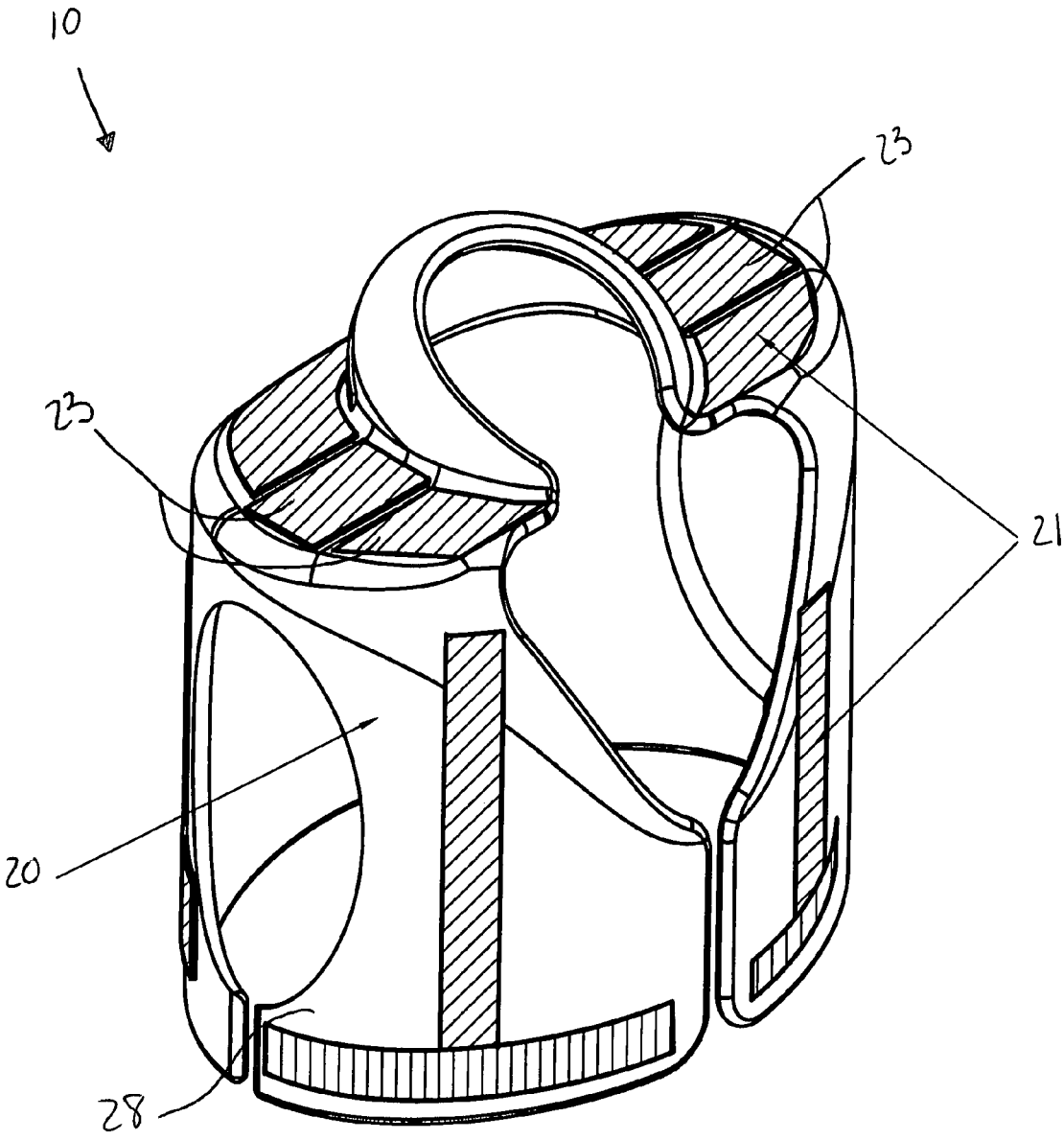
FIG. 2 is a perspective view showing the front of a reflective life jacket, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to protect a reflective life jacket. It should be understood that the apparatus 10 may be used at anytime of the day for various activities and should not limited in use to only those times of day and activities mentioned herein.

Referring initially to FIGS. 1, 2, 3 and 4, a reflective life jacket 10 includes a buoyant body 20 suitably sized and shaped for fitting over an upper thoracic cavity of a user. The apparatus 10 further includes a plurality of disposable stacked reflective strips 21, 50 positioned along selected regions of the body 20. Such an exposed reflective strip 21 includes a planar top wall 22 spanning across an entire width of the cavity, a plurality of shoulders 23 stepped inwardly towards a center of the cavity, and an anchor finger 24 with a triangular shape snuggly interfitted within the slit of the diaphragm 25 which is essential such that the exposed reflective strip 21 is prohibited from prematurely detaching from the cavity. Such an anchor finger 24 has a bottom surface directly abutted, without the use of intervening elements, against a top surface of the water impermeable layer 30. The exposed and reserved reflective strips 21, 50 are coextensively shaped. The body is for providing both flotation and visibility for a user in the water.

Figure 3:
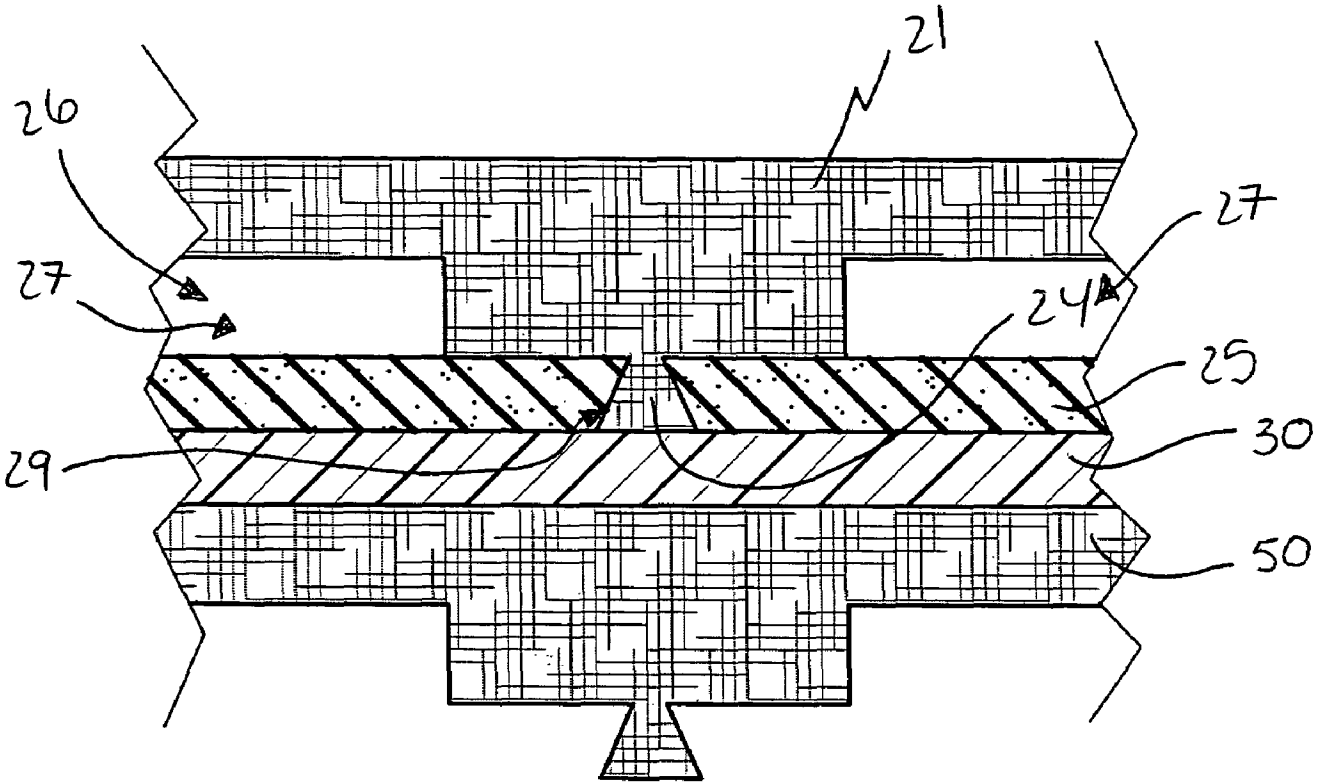
FIG. 3 is a cross sectional view of a reflective life jacket, showing the exposed reflective strips laying along the top surface of the body, in accordance with the present invention.
Figure 4:
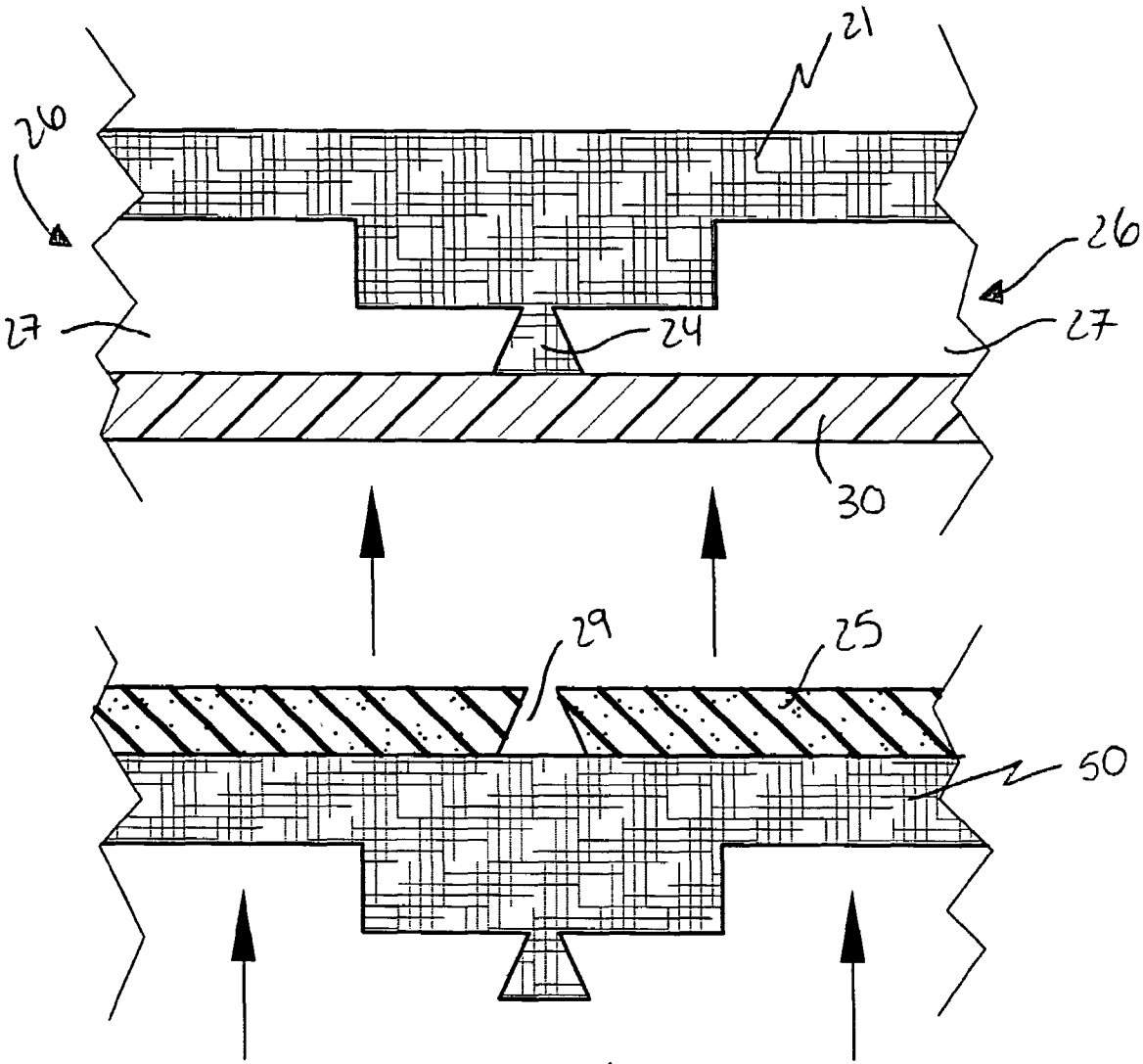
FIG. 4 is a cross sectional view showing the exposed reflective strips removed from the body, in accordance with the present invention.

Referring to FIGS. 3 and 4, the apparatus 10 further includes a mechanism 26 for removably affixing the reflective strips 21, 50 to the body 20 which is important such that an exposed one of the reflective strips 21 contiguously lays along a top surface 28 of the body 20 while a reserved one of the reflective strips 50 lays beneath the top surface and remains hidden from ambient light. Such a removably affixing mechanism 26 includes a cavity 27 formed within the top surface 28 of the body 20 and spanning along the selected regions thereof. The exposed reflective strip 21 is removably nested within the cavity 27. The exposed reflective strips 21 may be removed from the body 20 in order to wave said strips in the air and thereby attract attention to the user more quickly.

The mechanism 26 further includes a deformably resilient diaphragm 25 formed from elastic material spanning across an entire width of the cavity 27. Such a diaphragm 25 has a longitudinal slit 29 formed along a medial region thereof, and such a slit 29 is resiliently adaptable between expanded and equilibrium positions when the exposed reflective strip 21 and the diaphragm 25 are pulled out from the cavity 27 and the reserved reflective strip 50 is outwardly displaced to the outer surface of the body 20. The exposed reflective strips 21 are interfitted within the slit 29 of the diaphragm 25 and the diaphragm 25 is adaptable to allow easy removability of the strips 21.

Referring again to FIGS. 3 and 4, the apparatus 10 further includes a water impermeable layer 30 abutted directly, without the use of intervening elements, to the diaphragm 25 and removably housed within the cavity 27 for preventing undesirable fluids and debris from penetrating through the cavity 27 and contacting the reserved reflective strip 50 seated beneath the water impermeable layer 30. Such a water impermeable layer 30 is severed by the reserved reflective strip 50 in such a manner that the reserved reflective strip 50 passes upwardly through the slit 29 as the exposed reflective strip 21 is upwardly displaced within the cavity 27. When the exposed reflective strips 21 are removed from the body 20, the reserved reflective strips 50 then becomes visible.

In use, the reflective life jacket is simple and straightforward to operate. First, upon climbing aboard a boat, the user dons the unit as a conventional safety garment. Should a mishap occur while boating, such as the vessel capsizing or an accidental fall overboard, the user calmly waits for rescue. On populated bodies of water such as lakes and rivers, the reflective strips of the garment effectively reflect vessel lights and flashlights. This advantageously increases the victim's visibility to approaching boaters, instantly alerting them that someone is in need of assistance.

The apparatus includes a buoyant vest that has reflective material attached thereto. The vest is produced from durable foam rubber material that is encased within a sturdy nylon lining. Of course, the vest may be produced from a variety of alternate suitable materials, as is obvious to a person of ordinary skill in the art. A plurality of reflective strips is directly attached, without the use of intervening elements, to an exterior surface of the buoyant vest. Such reflective strips are vertically oriented and feature highly reflective colors such as orange or yellow. Of course, the reflective strips may be oriented in a variety of alternate ways and may feature various other colors, as is obvious to a person of ordinary skill in the art. Furthermore, of course, the buoyant vest can be manufactured in a variety of sizes to accommodate men, women, and children, as obvious to a person of ordinary skill in the art.

The present invention, as claimed, provides the unexpected and unpredictable benefit of a life jacket that both prevents drowning and enhances visibility to rescue crews. The exposed reflective strips 21 are removable for thereby waving in the air to better attract rescuers. In addition, the reserve set of reflective strips 50 become exposed when the first set 21 is removed. This ensures that the body 20 of the life jacket 10 will always be visible to rescuers. Such benefits overcome the prior art shortcomings.

The present invention is convenient and easy to use, lightweight yet durable in design, is comfortable to wear for extended periods of time and provides users with an easy, effective means of maintaining visibility should an accident occur. The safety garment effectively saves an accident victim from drowning, while also facilitating and expediting a rescue by allowing the boater to avoid the risk of extended exposure to the elements. Such a life jacket is easily seen by any other passing boaters, thus eliminating hours of fruitless searching in vast, dark ocean waters. Ideal for pleasure boaters as well as professional and recreational fishermen, the illuminated buoyant safety garment can also be used by the Coast Guard in training exercises or in the event Coast Guard members find themselves in trouble on the seas.

In use, a method for utilizing a reflective life jacket 10 providing catoptric characteristics during night time includes the steps of: providing a buoyant body 20 suitably sized and shaped for fitting over an upper thoracic cavity of a user; providing a plurality of disposable stacked reflective strips 21, 50 positioned along selected regions of the body 20; and removably affixing the reflective strips 21, 50 to the body 20 such that an exposed one of the reflective strips 21 contiguously lays along a top surface of the body 20 while a reserved one of the reflective strips 50 lays beneath the top surface and remains hidden from ambient light.

In use, the method further includes the steps of: providing a cavity 27 formed within the top surface 28 of the body 20 and spanning along the selected regions thereof such that the exposed reflective strip 21 is removably nested within the cavity 27; providing a deformably resilient diaphragm 25 formed from elastic material spanning across an entire width of the cavity 27; and providing a water impermeable layer 30 abutted directly to the diaphragm 25 and removably housed within the cavity 27 for preventing undesirable fluids and debris from penetrating through the cavity 27 and contacting the reserved reflective strip 50 seated beneath the water impermeable layer 30.

In use, the method further includes the steps of: resiliently adapting a slit 29 of the diaphragm 25 between expanded and equilibrium positions when the exposed reflective strip 21 and the diaphragm 25 are pulled out from the cavity 27; outwardly displacing the reserved reflective strip 50 to the outer surface of the body 20; snuggly interfitting a triangular shaped anchor finger 24 within the slit 29 of the diaphragm 25 such that the exposed reflective strip 21 is prohibited from prematurely detaching from the cavity 27; and severing the water impermeable layer 30 in such a manner that the reserved reflective strip 5Q passes upwardly through the slit 29 as the exposed reflective strip 21 is upwardly displaced within the cavity 27.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A reflective life jacket providing catoptric characteristics during night time, said reflective life jacket comprising:

a body suitably sized and shaped for fitting over an upper thoracic cavity of a user;

a plurality of stacked reflective strips positioned along selected regions of said body; and means for removably affixing said reflective strips to said body such that an exposed one of said reflective strips contiguously lays along a top surface of said body while a reserved one of said reflective strips lays beneath said top surface and remains hidden from ambient light;

wherein said removably affixing means comprises a cavity formed within said top surface of said body and spanning along said selected regions thereof, said exposed reflective strip being removably nested within said cavity;

a deformably resilient diaphragm formed from elastic material spanning across an entire width of said cavity; and a water impermeable layer abutted directly to said diaphragm and removably housed within said cavity for preventing undesirable fluids and debris from penetrating through said cavity and contacting said reserved reflective strip seated beneath said water impermeable layer.

2. The reflective life jacket of claim 1, wherein said diaphragm has a longitudinal slit formed along a medial region thereof, said slit being resiliently adaptable between expanded and equilibrium positions when said exposed reflective strip and said diaphragm are pulled out from said cavity and said reserved reflective strip is outwardly displaced to said outer surface of said body.

3. The reflective life jacket of claim 2, wherein said exposed reflective strip comprises:

a planar top wall spanning across an entire width of said cavity;

a plurality of shoulders stepped inwardly towards a center of said cavity; and an anchor finger having a triangular shape snuggly interfitted within said slit of said diaphragm such that said exposed reflective strip is prohibited from prematurely detaching from said cavity;

wherein said anchor finger has a bottom surface directly abutted against a top surface of said water impermeable layer.

4. The reflective life jacket of claim 3, wherein said water impermeable layer is severed by said reserved reflective strip in such a manner that said reserved reflective strip passes upwardly through said slit as said exposed reflective strip is upwardly displaced within said cavity.

5. The reflective life jacket of claim 1, wherein said exposed and reserved reflective strips are coextensively shaped.

6. A reflective life jacket providing catoptric characteristics during night time, said reflective life jacket comprising:

a buoyant body suitably sized and shaped for fitting over an upper thoracic cavity of a user;

a plurality of disposable stacked reflective strips positioned along selected regions of said body; and means for removably affixing said reflective strips to said body such that an exposed one of said reflective strips contiguously lays along a top surface of said body while a reserved one of said reflective strips lays beneath said top surface and remains hidden from ambient light;

wherein said removably affixing means comprises a cavity formed within said top surface of said body and spanning along said selected regions thereof, said exposed reflective strip being removably nested within said cavity;

a deformably resilient diaphragm formed from elastic material spanning across an entire width of said cavity; and a water impermeable layer abutted directly to said diaphragm and removably housed within said cavity for preventing undesirable fluids and debris from penetrating through said cavity and contacting said reserved reflective strip seated beneath said water impermeable layer.

7. The reflective life jacket of claim 6, wherein said diaphragm has a longitudinal slit formed along a medial region thereof, said slit being resiliently adaptable between expanded and equilibrium positions when said exposed reflective strip and said diaphragm are pulled out from said cavity and said reserved reflective strip is outwardly displaced to said outer surface of said body.

8. The reflective life jacket of claim 7, wherein said exposed reflective strip comprises:

a planar top wall spanning across an entire width of said cavity;

a plurality of shoulders stepped inwardly towards a center of said cavity; and an anchor finger having a triangular shape snuggly interfitted within said slit of said diaphragm such that said exposed reflective strip is prohibited from prematurely detaching from said cavity;

wherein said anchor finger has a bottom surface directly abutted against a top surface of said water impermeable layer.

9. The reflective life jacket of claim 7, wherein said water impermeable layer is severed by said reserved reflective strip in such a manner that said reserved reflective strip passes upwardly through said slit as said exposed reflective strip is upwardly displaced within said cavity.

10. The reflective life jacket of claim 6, wherein said exposed and reserved reflective strips are coextensively shaped.

11. A method for utilizing a reflective life jacket providing catoptric characteristics during night time, said method comprising the steps of:

a. providing a buoyant body suitably sized and shaped for fitting over an upper thoracic cavity of a user;

b. providing a plurality of disposable stacked reflective strips positioned along selected regions of said body; and c. removably affixing said reflective strips to said body such that an exposed one of said reflective strips contiguously lays along a top surface of said body while a reserved one of said reflective strips lays beneath said top surface and remains hidden from ambient light;

wherein step b. comprises the steps of d. providing a cavity formed within said top surface of said body and spanning along said selected regions thereof such that said exposed reflective strip being removably nested within said cavity;

e. providing a deformably resilient diaphragm formed from elastic material spanning across an entire width of said cavity; and f. providing a water impermeable layer abutted directly to said diaphragm and removably housed within said cavity for preventing undesirable fluids and debris from penetrating through said cavity and contacting said reserved reflective strip seated beneath said water impermeable layer.

12. The method of claim 11, wherein step b. comprises the steps of:

a. resiliently adapting a slit of said diaphragm between expanded and equilibrium positions when said exposed reflective strip and said diaphragm are pulled out from said cavity; and b. outwardly displacing said reserved reflective strip to said outer surface of said body.

13. The method of claim 12, wherein step b. comprises the steps of:

snuggly interfitting a triangular shaped anchor finger within said slit of said diaphragm such that said exposed reflective strip is prohibited from prematurely detaching from said cavity.

14. The method of claim 13, further comprising the step of:

severing said water impermeable layer in such a manner that said reserved reflective strip passes upwardly through said slit as said exposed reflective strip is upwardly displaced within said cavity.

* * * * *